United States Patent [19]

Whitehurst et al.

[11] 4,437,863

[45] Mar. 20, 1984

[54] PEAT FUEL SLURRY

[76] Inventors: Brooks M. Whitehurst, 1983 Hoods Creek Dr., New Bern, N.C. 28560; Donald F. Clemens, 1701 Sulgrave Rd., Greenville, N.C. 27834

[21] Appl. No.: 346,161

[22] Filed: Feb. 5, 1982

[51] Int. Cl.[3] ..... C10L 1/32

[52] U.S. Cl. ..... 44/51

[58] Field of Search ..... 44/51; 366/102, 103, 366/104

[56] References Cited

U.S. PATENT DOCUMENTS 773,992 11/1904 Schlickeysen ..... 44/27
827,139 7/1906 Browne et al. ..... 44/51
3,603,643 9/1971 Hirota ..... 44/30
4,153,420 5/1979 Myreen ..... 44/33

*Primary Examiner*—Charles F. Warren
*Assistant Examiner*—Margaret B. Medley
*Attorney, Agent, or Firm*—John S. Roberts, Jr.

[57] ABSTRACT

A process and product for a peat fuel composition which comprises dispersing peat loaded at about 30–50% by weight of the composition and normally containing 20–50% $H_2O$ in a fuel oil mix which is 40–50% No. 6 and 10–20% No. 2 fuel oil. Alternatively, the final oil mix may have a viscosity between No. 6 fuel oil and No. 5 fuel oil or between 350 and 150 in seconds, Universal Saybolt (minimum) stability.

3 Claims, 1 Drawing Figure

PLOT OF HEAT CONTENT (MJ/Kg) VERSUS % VOLATILE CONTENT ON A GRID OF % HYDROGEN VERSUS % CARBON FOR COAL, LIGNITE, PEAT, AND WOOD.

PLOT OF HEAT CONTENT (MJ/Kg) VERSUS % VOLATILE CONTENT ON A GRID OF % HYDROGEN VERSUS % CARBON FOR COAL, LIGNITE, PEAT, AND WOOD.
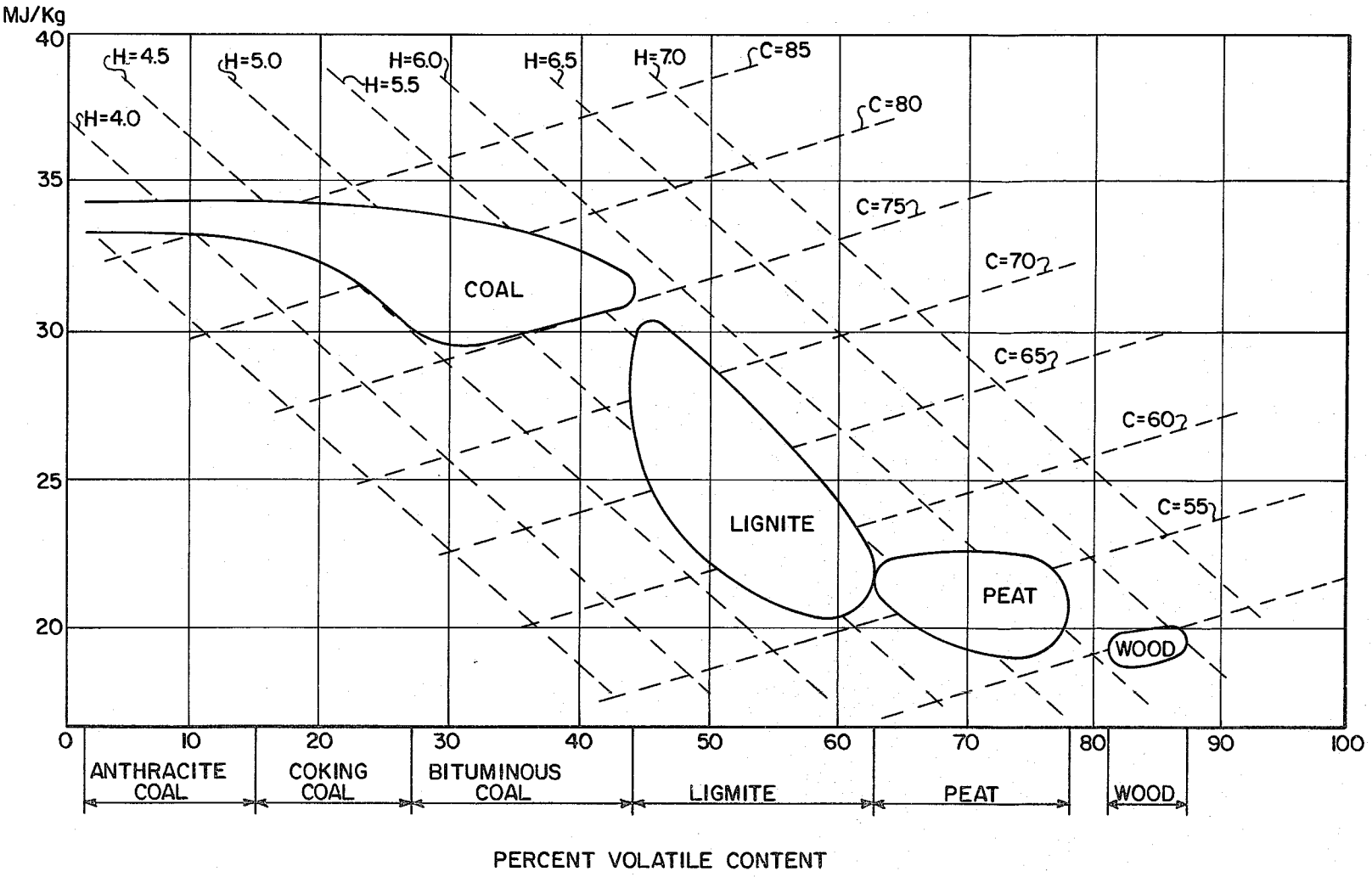

PEAT FUEL SLURRY

This invention relates to a process and product for a peat fuel composition which comprises dispersing peat loaded at about 30–50% by weight and normally containing 20–50% $H_2O$ in a fuel oil mix which is 40–50% No. 6 and 10–20% No. 2 fuel oil. Alternatively, the final oil mix may have a viscosity between that of Fuel Oil No. 6 and Fuel Oil No. 5 or between 350 and 150 in seconds, Universal Saybolt (minimum).

The aeration or air entrapment which is utilized to bring down the viscosity of the dispersion is important in this invention. Also, air entrainment in the slurry is a function of the moisture content of the peat and the shear rate of the mixer. These parameters tend to lower and control the viscosity of the mixtures.

The peat, or preferably North Carolina peat which has a higher wood fiber content than other types of peat, is processed as follows: cut from the ground, air dried to moisture content varying from 20 to 50% $H_2O$, ground in a mill so that 65% or more of the ground peat will pass a 65 mesh sieve (U.S. standard). The peat is then mixed with 40 to 50 weight % No. 6 fuel oil and 10–20% No. 2 fuel oil. A chart showing the various SAE oils by grade designation is set out below.

Air entrainment of the slurry as aforesaid is a function of moisture content of the peat and the shear rate of the mixer—these parameters maintain and control the viscosity of the mixture.

| Fuel Oil Grade | Description and Requirements for Use | Flash Point °F. (°C.) | Saybolt Viscosity, sec. Universal at 100° F. (38° C.) Min. | Universal Max. | Furol at 122° F. (50° C.) Min. | Furol Max. |
|---|---|---|---|---|---|---|
| No. 1 | A distillate oil intended for vaporizing pot-type burners and other burners requiring this grade of fuel | 100 or legal (38) | — | — | — | — |
| No. 2 | A distillate oil for general purpose domestic heating for use in burners not requiring No. 1 fuel oil | 100 or legal (38) | (32.6) | (37.93) | — | — |
| No. 4 | Preheating not usually requiring for handling or burning | 130 or legal (55) | 45 | 125 | — | — |
| No. 5 (light) | Preheating may be required depending on climate and equipment | 130 or legal (55) | 150 | 300 | — | — |
| No. 5 (heavy) | Preheating may be required for aburning & in cold climates, may be required for handling | 130 or legal (55) | 350 | 750 | (23) | (40) |
| No. 6 | Preheating required for burning and handling | 150 (65) | (900) | (9000) | 45 | 300 |

STATEMENT OF PRIOR ART

U.S. Pat. No. 4,153,420 (Myreen) teaches the wet carbonizing of peat by steam or water treatment.

U.S. Pat. No. 3,603,643 (Hirota et al) teaches forming a peat slurry and separating said slurry into a fibrous component and humic component in water.

DESCRIPTION OF THE INVENTION

This invention contemplates a method of dispersing peat in a mix of No. 6 and No. 2 fuel oil. The following are specific examples:

| | Peat | No. 6 | No. 2 | $H_2O$ in Peat |
|---|---|---|---|---|
| #1 | 36.4% | 54.5% | 9.1% | 30% |
| #2 | 36.4% | 54.5% | 9.1% | 40% |
| #3 | 49.2% | 42.4% | 8.5% | 40% |

These experimental mixes were made in a Hamilton Beach blender. With the shearing action of this blender, air was entrained or trapped in the slurry and separated very slowly, resulting in a low viscosity blend. Air loss from the slurry was found to be a function of the moisture content of the peat.

| Sample No. | % $H_2O$ | Volume Reduction in Sample After 24 Hours of Standing |
|---|---|---|
| #1 | 30 | 7.1% |
| #2 | 40 | 4.8% |
| #3 | 40 | 3.7% |

GENERALIZED PROCESS

Peat was harvested, air dried, and ground to at least 65% minus 65 mesh, and intimately mixed with a combination of No. 2 and No. 6 fuel oil. The water content of the peat was about 40%. Tests have shown that this process will not readily work for peat moisture contents below 20%. However, the maximum percentage of water required is much less stringent. A composition of 40–50% No. 6 fuel oil and 10% No. 2 fuel oil was placed in the blender at a 40% peat load. The ground water content of the peat was 40%. A dispersion was produced which was found to be easily combustible, satisfying the need for an inexpensive, easy-toproduce fuel.

North Carolina peat, by definition, is largely formed by the inhibited decay of cypress and white cedar trees and is different from the peat harvested in many parts of the world. North Carolina peat has several characteristics making it very attractive as a fuel source or as a chemical feedstock. Not only is the sulfur and ash content relative low, but also the high carbon and hydrogen content and high heat content indicate that the North Carolina peat is similar to a young lignite.

DESCRIPTION OF THE DRAWING

The FIGURE is a plot of heat content MJ/Kg versus percent volatile content on a grid of percent hydrogen versus percent carbon for coal, lignite, peat, and wood.

We claim:

1. A peat fuel composition (30 to 50% peat) which is a product of dispersing a ground North Carolina type peat with a moisture of 20–50% by weight in a fuel oil mixture of No. 6 fuel oil (40–50%) and No. 2 fuel oil (10–20%) and aerating said peat to entrap air in the composition.

2. An aerated peat fuel composition which is a product of a process of dispersing a ground North Carolina type peat with a moisture between 20 and 50% with a fuel oil composition with a viscosity, sec. Universal Saybolt intermediate No. 6 fuel oil and No. 5 fuel oil (minimum) or 350 to 150 and aerating said composition.

3. A method of producing a fuel composition (30–50% peat) which comprises dispersing peat with a preferred moisture content of 20–50 weight percent in a mix of fuel oil containing (40–50%) No. 6 fuel oil and ≧10–20% No. 2 fuel oil.

* * * * *